US005083738A

United States Patent [19]

Infanti

[11] Patent Number: 5,083,738

[45] Date of Patent: Jan. 28, 1992

[54] DETACHABLE GAME STOOL ASSEMBLY

[75] Inventor: Vittorio Infanti, Matawan, N.J.

[73] Assignee: Infanti Chair Manufacturing Corp., Staten Island, N.Y.

[21] Appl. No.: 676,000

[22] Filed: Mar. 26, 1991

[51] Int. Cl.[5] ..... A47B 97/00

[52] U.S. Cl. ..... 248/500; 248/225.1; 297/174

[58] Field of Search ..... 248/500, 503, 222.1, 248/222.2, 224.4, 231.6, 316.6, 225.1; 297/174; 182/230, 222

[56] References Cited

U.S. PATENT DOCUMENTS 4,149,694 4/1979 Verini ..... 248/231.6 X 4,840,343 6/1989 Gasser ..... 248/500

FOREIGN PATENT DOCUMENTS 2156889 10/1985 United Kingdom ..... 182/230

*Primary Examiner*—Alvin C. Chin-Shue

*Attorney, Agent, or Firm*—Anthony J. Casella; Gerald E. Hespos

[57] ABSTRACT

An assembly is provided for detachably supporting a stool relative to a casino gaming machine comprising an elongated planar base member having an upturned portion at one end, a chair configuration extending from the base opposite the upturned portion, and a rigid support member fixed to the base of a gaming machine. The rigid support member is intended to prohibit lateral and longitudinal movement of the base member of the assembly relative to the base of the casino gaming machine. The upturned portion of the base member may be detachably engaged with the fixed support member to permit access to a cash box located in the base of the gaming machine.

7 Claims, 2 Drawing Sheets

DETACHABLE GAME STOOL ASSEMBLY

BACKGROUND OF THE INVENTION

Casino gaming machines, in particular slot machines, are often used by patrons for extended periods of time. It is therefore common place to provide the user of a gaming machine a chair or stool to ensure their comfort. However, chairs often become displaced to locations remote from their intended position adjacent the gaming machine. The dislocation of the chairs with respect to the gaming machines detract from the aesthetic appearance of the symmetric gaming machines, and may interfere with the flow of traffic in the casino. Thus, it is desirable to provide a means for attaching a chair to a casino gaming machine, such that the chair will not get displaced. However, it is also necessary, on a daily basis, to access a cash box generally located on the lower front surface of the gaming machine. Therefore, a chair that is fixed to a gaming machine must be provided with a means of disengagement such that an operator may easily access the cash box.

Prior art devices of this type have relied on a variety of different support configurations to space and secure a seat in relation to a gaming machine. One such prior art device comprises a flat base member having a fastening plate on one end disposed perpendicular to the plane thereof, and having an upstanding seat configuration adjacent the opposite end thereof. The fastening plate is provided with a plurality of bolt holes for fastening the base member to the base of a casino gaming machine. Moreover, the fastening plate, once bolted, is not readily removable from the base of the casino gaming machine. Therefore, in order to access the cash box located within the base of the gaming machine an attendant must position himself, in a crouched condition, between the gaming machine and the upstanding seat configuration so as to remove the coinage from the cash box.

U.S. Pat. No. 4,840,343 entitled "QUICK RELEASE SEAT SUPPORT" which issued to George E. Gasser on June 20, 1989 includes a flat body member having an upturned portion at one end and a chair configuration extending adjacent the opposite end thereof. The quick release seat support further includes an inverted U-shaped spring member which is fixed to the base of a casino gaming machine. The spring member includes ar upright engagement portion having an outwardly extending flange portion with a downturned angularly inclined spring portion. In operation, the upturned portion of the flat body member is inserted into the elongated spring member such that the downturned angularly inclined spring portion deflects resiliently to allow registration of the upturned portion within the spring member. Thereafter, the downturned angularly inclined spring portion returns to its inwardly biased neutral position so as to apply a holding force against the upturned portion of the base member to resiliently inhibit movement of the base member within the spring member.

Inherent in the design of the quick release seat support disclosed in U.S. Pat. No. 4,840,343 are several shortcomings. Primarily, the angularly inclined spring portion is fragile and may, over time, lose its resilient quality thereby reducing the magnitude of the force that is necessary to inhibit the lateral movement of the upturned portion of the flat body member therein. This may occur as a result of mishandling of the chairs, or even from the constant body movements of game players. Furthermore, continual daily removal of the upturned portion of the flat body member from the spring member in order to access a cash box and subsequent reinsertion therein may cause the resilient material of the spring member to become fatigued and eventually the spring portion may fracture and break. Still further, should the spring portion become weakened or bent, it may not be possible to accurately align the gaming chairs with the gaming machines. Thus, over time the asymmetric alignment of the gaming chairs may detract from the aesthetic appearance of the casino.

It is therefore an object of the subject invention to provide a detachable game stool assembly having a substantially rigid support member which will prohibit longitudinal and lateral movement of the base of the stool relative to the base of a casino gaming machine.

It is a further object of the subject invention to provide a detachable game stool assembly having a substantially rigid support member which will not deform as a result of repeated engagements with the base of the game stool.

It is a further object of the subject invention to provide a detachable game stool assembly having a rigid support member which will not weaken from a severe shock or vibrations.

SUMMARY OF THE INVENTION

The subject invention is directed to an assembly for detachably connecting a seat configuration to a casino gaming machine. The detachable game stool assembly of the subject invention basically comprises an elongated flat base member having an upturned portion at one end, a chair assembly secured to the base adjacent the end opposite the upturned portion, and a support member fixed to the base of a casino gaming machine. The fixed support member is intended to prohibit longitudinal and lateral movement of the base member relative to the base of the casino gaming machine. In operation, the base member may be readily disengaged from the fixed support member to permit easy access to a cash box located inside the gaming machine.

The support member of the detachable game stool assembly of the subject invention comprises an elongated substantially rectangular base plate provided with spaced apart bolt holes for fastening the base plate to the base of the game machine. The support member further comprises rigid connective means extending from the base plate for positive engagement with the upturned portion of the base member to prohibit lateral movement of the base member relative to the game machine. The connective means may be cylindrical rods or rectangular beams disposed is spaced apart relationship. The support member further comprises rigid retaining means attached to the connective means to prohibit longitudinal movement of the upturned portion of the base member relative to the base of the casino gaming machine. The retaining means may be one or more substantially rectangular planar beams disposed in spaced apart parallel relationship with the base plate of the support member to form a generally rectangular engagement slot therebetween for positively receiving the upturned portion of the base member.

In summary, a detachable game stool assembly is provided comprising an elongated base member having an upturned portion at one end and having an upstanding seat configuration adjacent the opposite end thereof, and a rigid support member fixed to the base of a casino gaming machine for engaging the upturned portion of the elongated base member so as to prohibit longitudinal and lateral movement of the base member relative to the casino gaming machine.

DETAILED DESCRIPTION OF THE PREFERRED EMBODIMENT

Figure 1:
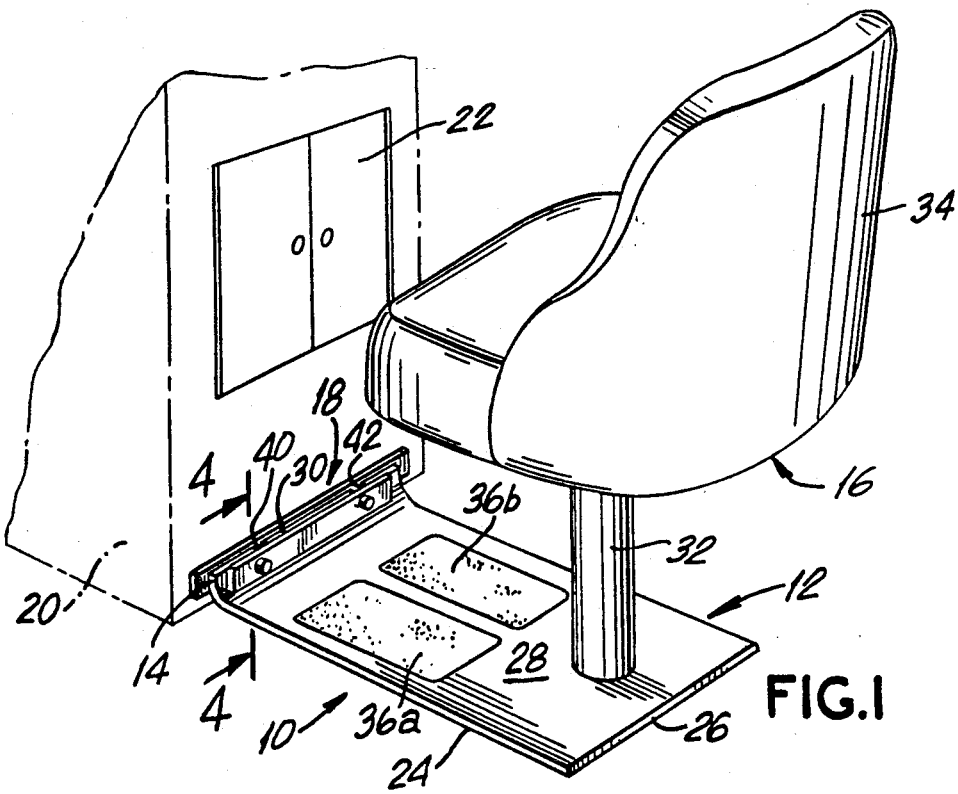
FIG. 1 is a perspective view of the detachable game stool assembly of the subject invention.
Figure 2:
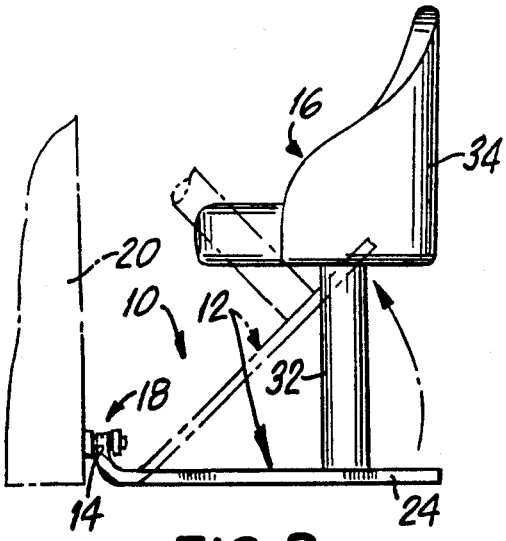
FIG. 2 is a side elevational view of the detachable game stool assembly of the subject invention.

The detachable game stool assembly of the subject invention is illustrated in FIG. 1 and is designated generally by reference numeral 10. The detachable game stool assembly 10 of the subject invention basically comprises an extruded elongated flat base member 12 having an upturned portion 14 at one end, a chair configuration 16 extending from the base member opposite the upturned portion 14, and a rigid support member 18 fixed to the base of a gaming machine 20 having a cash box 22. The upturned portion 14 of the base member 12 may be detached from the rigid support member 18 such that an attendant may have easy access to the cash box 22 in gaming machine 20, as illustrated in FIG. 2.

The extruded base member 12 cf the detachable game stool assembly 10 of the subject invention comprises an elongated flat portion 24 having a rear edge 26 and having an upper surface face 28. The base member 12 is formed with upturned engaging portion 14 extending perpendicular to the plane thereof having a distal edge 30. An upstanding seat configuration 16 is secured to the base member 12 adjacent the rear edge 26 thereof. The seat configuration 16 includes a cylindrical post 32 with a cushioned seat 34 secured thereto. The upper surface face 28 of the flat portion 24 of the base member 12 is provided with a pair of generally rectangular non-slip traction pads **36*a* and 36*b* disposed in spaced apart relationship intermediate post 32 of the seat configuration 16 and the upturned engaging portion 14. The traction pads 36*a* and 36*b* are provided to prevent a user from slipping upon standing up from the seat 34. Alternatively, referring to FIG. 3, the elongated flat portion 24 of the base member 12 may include a plurality cf striations 38*a* and 38*b* disposed in spaced apart relationship along the length of base member 12, parallel to the longitudinal axis of the elongated flat portion 24. The striations 38*a* and 38*b* are provided to prevent a user form slipping upon standing up from the seat 34. The upturned portion 14 of the base member 12 is provided with a pair of spaced apart semi-circular engaging notches 40 and 42. The engaging notches 40 and 42 are disposed in distal edge 30 of the upturned portion 14 of the base member 12**.

The rigid support member 18 of the detachable game stool assembly 10 of the subject invention includes a pair of rigid parallel generally rectangular beams 44 and 46 connected in spaced apart relationship to one another by a pair of cylindrical rods 48 and 50 to form an engagement slot 52 therebetween. The cylindrical rods 48 and 50 are spaced apart to correspond with the spacing of the notches 40 and 42 disposed in distal edge 30 of the upturned portion 14 of the base member 12. Rectangular beam 44 includes a pair of spaced apart bolt holes 54 and 56 for fastening the rigid support member 18 to the base of the gaming machine 20.

Figure 3:
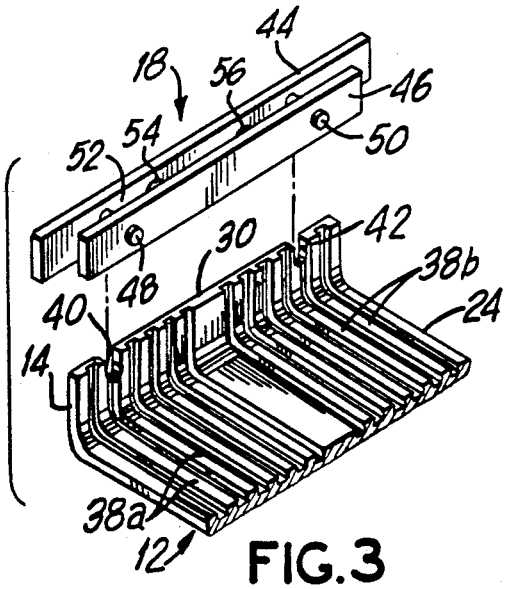
FIG. 3 is a perspective view of a portion of the detachable game stool assembly of the subject invention illustrating the fixed support member.
Figure 4:
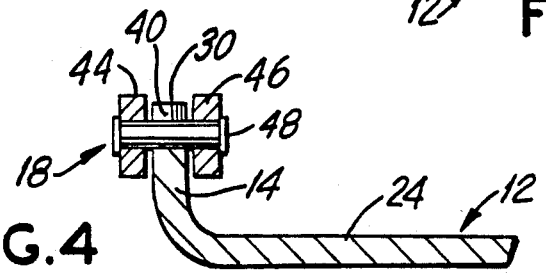
FIG. 4 is a cross-sectional view taken along line 4—4 of FIG. 1 illustrating the inter-engagement of the base member and the fixed support member of the detachable game stool assembly of the subject invention.

Referring to FIGS. 3 and 4., to install the detachable game stool assembly 10 of the subject invention, the upturned portion 14 of the base member 12 is inserted between the parallel beams 44 and 46 of the rigid support member 18 of the detachable game stool assembly 10 such that the cylindrical rods 48 and 50 are in registration with the notches 40 and 42. At such a time, the intimate registration of the notches 40 and 42 with the cylindrical rods 48 and 50 prohibits lateral movement of the base member 12 of the detachable game stool assembly 10 relative to the base of the gaming machine 20. Furthermore, the rigid rectangular beam 46 of the fixed support member 18 prohibits longitudinal movement of the base member 12 of the detachable game stool assembly 10 relative to the base of the gaming machine 20.

Referring to FIG. 2, the base member 12 of the detachable game stool assembly 10 may be tilted such that the upturned portion 14 disengages the rigid support member 18. Thereafter, the entire seat configuration may be moved to a location remote from the gaming machine 20 such that an operator may easily access the cash box 22 located in the gaming machine 20. Subsequently, the upturned portion 14 of the base member 12 of the detachable game stool assembly 10 may be reinserted into the rigid support member 18.

Figure 5:
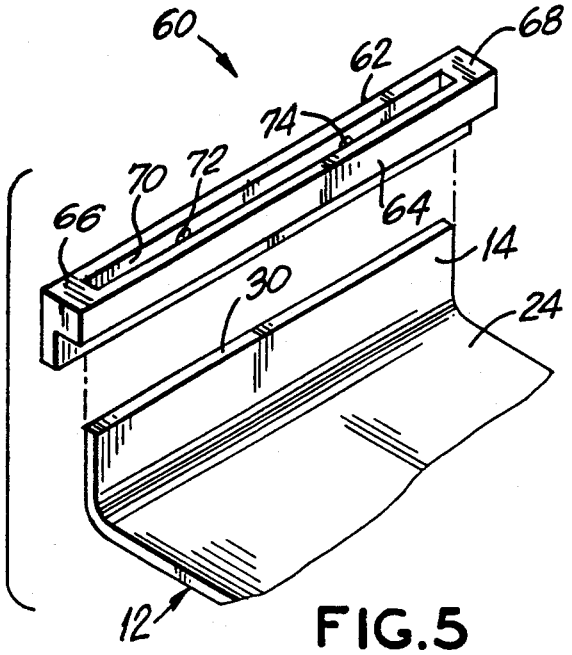
FIG. 5 is a perspective view of a second embodiment of the fixed support member of the detachable game stool assembly of the subject invention.

Turning to FIG. 5, an alternate embodiment of the rigid support member of the subject invention is illustrated and is generally designated by reference numeral 60. The rigid support member 60 comprises a unitary member having a pair of elongated generally rectangular rigid support beams 62 and 64, rigidly connected to one another by a pair of rigid end stops 66 and 68 to form a generally rectangular engagement slot 70 therebetween. Support beam 62 includes a pair of spaced apart bolt holes 72 and 74 for fastening support member 60 &.o the base of the gaming machine 20.

Figure 6:
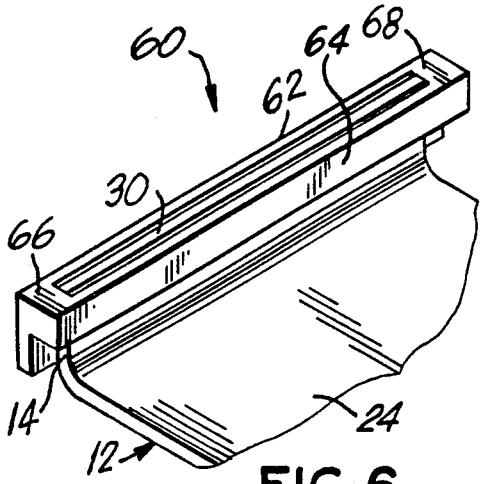
FIG. 6 is a perspective view of the second embodiment of the fixed support member of the detachable game stool assembly of the subject invention.

Turning to FIG. 6, in operation, the upturned portion 14 of the base member 12 of the detachable game stool may be secured in the generally rectangular engagement slot 70 of the rigid support member 60. At such a time, the rigid support member 70 effectively prohibits longitudinal and lateral movement of the base member 12 relative to the base of the gaming machine 20.

Figure 7:
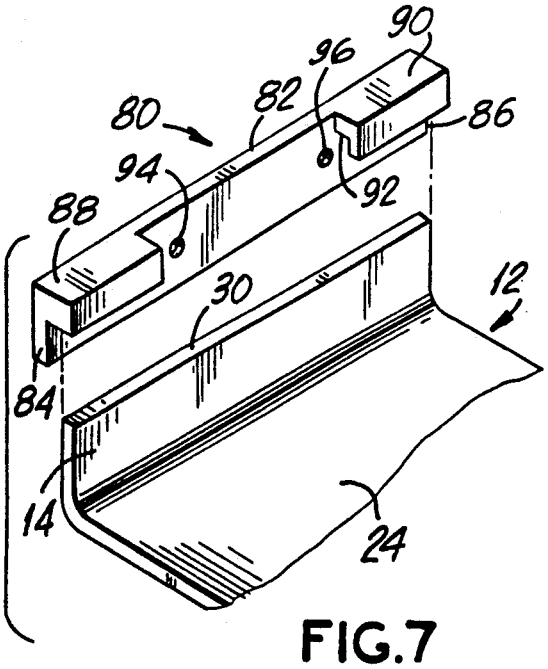
FIG. 7 is a perspective view of a third embodiment of the fixed support member of the detachable game stool assembly of the subject invention.

Referring to FIG. 7, a third embodiment of the rigid support member of the subject invention is illustrated and is designated generally by reference numeral 80. The rigid support member 80 comprises an elongated flat beam 82 having distal edges 84 and 86. The rigid support member further comprises a pair of spaced apart generally L-shaped rigid channel beams 88 and 90 disposed adjacent distal ends 84 and 86 thereof, respectively, to form a generally rectangular engagement slot 92 therebetween. Flat beam member 82 includes a pair of spaced apart bolt holes 94 and 96 for fastening support member 80 to the base of the gaming machine 20.

Figure 8:
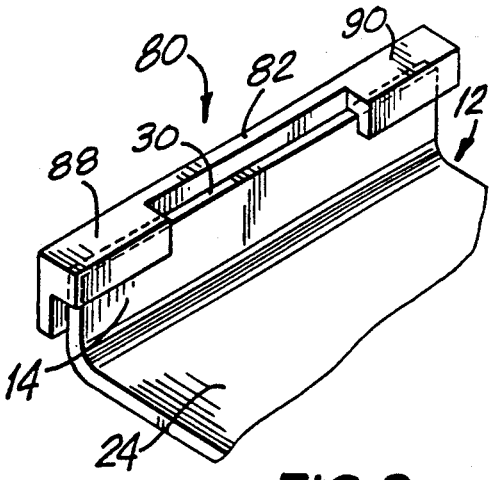
FIG. 8 is a perspective view of the third embodiment of the fixed support member of the detachable game stool assembly of the subject invention.

Turning to FIG. 8, in operation, the upturned portion 14 of the base member 12 of the detachable game stool 10 may be secured in the generally rectangular engagement slot 92 of the rigid support member 80. At such a time, the rigid support member 80 effectively prohibits longitudinal and lateral movement of the upturned portion 14 of the base member 12 relative to the base of the gaming machine 20.

In summary, a detachable game stool assembly is provided comprising an elongated base member having an upturned portion at one end and having a seat configuration disposed on the other end, and a rigid support member fixed to a gaming machine which cooperates with the upturned portion such that the upturned portion of the base member may be detachable engaged therein.

While the invention has been described with respect to a preferred embodiment, it is apparent that various changes may be made without departing from the scope of the invention as defined by the appended claims.

I claim:

1. A detachable game stool assembly comprising:

an elongated generally planar base member having opposed front and rear edges, said front edge of said base member being upturned to form an upturned engaging portion generally perpendicular to the plane of said base member, said upturned engaging portion including a pair of spaced apart generally semi-circular notches disposed therein;

an upstanding seat configuration secured to said elongated base member adjacent said rear edge thereof; and a support member fixed to the base of a gaming machine for detachable engagement with said upturned engaging portion of said base member, said support member having an elongated substantially rectangular planar base plate, a pair of spaced apart rigid cylindrical connective rods extending from said planar base plate and engageable with said semi-circular notches in said upturned engaging portion for prohibiting lateral movement of said upturned portion of said base member relative to said gaming machine, rigid retaining means attached to said rigid cylindrical connective rods for prohibiting longitudinal movement of said upturned portion of said base member relative to said gaming machine, said rigid retaining means and said planar base plate being disposed in parallel spaced apart relationship to one another, to form a generally rectangular engagement slot therebetween, whereby said upturned portion of said base member may be extended into said engagement slot and thereupon become detachably engaged therein.

2. A detachable game stool assembly as in claim 1 wherein said elongated planar base member is provided with a plurality of elongated striations disposed in spaced apart parallel relationship on the upper surface thereof.

3. A detachable game stool assembly as in claim 2 wherein said plurality of striations include first and second spaced apart sets of elongated striations.

4. A detachable game stool assembly comprising:

an elongated generally planar base member having opposed front and rear edges, said front edge of said base member being upturned to form an engaging portion generally perpendicular to the plane thereof, said upturned engaging portion including a pair of spaced apart generally semi-circular notches disposed therein;

an upstanding seat configuration secured to said elongated base member adjacent said rear edge thereof; and a support member fixed to the base of a gaming machine, said support member having a substantially rectangular planar base plate, a pair of spaced apart rigid cylindrical connective rods extending from said base plate, said rods being spaced apart to correspond with said spaced apart notches is said upturned portion of said base member, a rigid substantially rectangular planar retaining plate connected to said cylindrical connective rods such that said base plate and said retaining plate are substantially parallel to one another to form an engagement slot therebetween, whereby the upturned portion of the base member of said assembly may be extended into the engagement slot such that the notches in said upturned engaging portion and the connective rods of said support may be aligned and subsequently detachably engaged so as to prohibit longitudinal and lateral movement of said upturned portion of the base member of said assembly relative to said game machine.

5. A detachable game stool assembly as in claim 4 wherein said elongated planar base member is provided with a pair of generally rectangular non-skid pads on the upper surface thereof.

6. A detachable game stool assembly as in claim 4 wherein said elongated planar base member is provided with a plurality of elongated striations disposed in spaced apart parallel relationship on the upper surface thereof.

7. A detachable game stool assembly as in claim 6 wherein said plurality of striations include first and second spaced apart sets of elongated striations.

* * * * *